US012251064B1

(12) United States Patent
del Pilar Torres

(10) Patent No.: US 12,251,064 B1
(45) Date of Patent: Mar. 18, 2025

(54) MOP HEAD ASSEMBLY

(71) Applicant: Maria del Pilar Torres, ft Lauderdale, FL (US)

(72) Inventor: Maria del Pilar Torres, ft Lauderdale, FL (US)

( * ) Notice: Subject to any disclaimer, the term of this patent is extended or adjusted under 35 U.S.C. 154(b) by 0 days.

(21) Appl. No.: 18/964,751

(22) Filed: Dec. 2, 2024

(51) Int. Cl.
*A47L 13/24* (2006.01)

(52) U.S. Cl.
CPC ..... *A47L 13/24* (2013.01)

(58) Field of Classification Search
CPC ..... A47L 13/20; A47L 13/24; A47L 13/25; A47L 13/252; A47L 13/52; B25G 3/18
See application file for complete search history.

(56) References Cited

U.S. PATENT DOCUMENTS 6,023,812 A * 2/2000 Morad ..... A47L 13/52 15/257.7
6,029,308 A * 2/2000 Smith ..... A47L 13/24 15/228
2024/0115106 A1* 4/2024 Spenneberg, Jr. ..... A47L 13/58

* cited by examiner

*Primary Examiner* — Shay Karls
(74) *Attorney, Agent, or Firm* — Ruben Alcoba, Esq.

(57) ABSTRACT

A mop head assembly designed for microfiber mops, featuring a mop head receiver, a microfiber mop, and a mop head pressure insert. The mop head receiver includes an upper side with a detachable handle receiver and a lower side with a circumferential wall, outward-extending projections arranged circularly, and uniformly spaced pressure insert receiving apertures. The microfiber mop is positioned on the lower side of the receiver. The mop head pressure insert consists of either a quadrilateral frame with an interior cruciform structure connected to its corners, or a plate structure. The structure features outward projections and pressure inserts extending perpendicularly, which align and secure into the receiving apertures of the mop head receiver. This assembly ensures a secure connection between the microfiber mop and handle, enhancing cleaning efficiency and durability.

15 Claims, 6 Drawing Sheets

MOP HEAD ASSEMBLY

BACKGROUND

The present invention is directed to a mop head assembly for microfiber mops.

Microfiber mops are widely regarded for their cleaning efficiency and environmental benefits, but they do come with some disadvantages. One of them is the often unreliable connection between the microfiber mop and the mop head assembly, which tends to provide inadequate grip that results in frequent detachment during use, uneven cleaning performance, increase wear and tear, time-consuming reattachment, reduced cleaning effectiveness and failure under heavy loads. More specifically, in the case of projections or pressure-insert systems, these might not securely hold the microfiber mop if improperly aligned or worn out.

The absence of more robust mop head assemblies for microfiber mops can be attributed to a combination of design, cost, and usability factors, as discussed next:

Cost considerations: increased manufacturing costs: developing and integrating more robust assemblies often involves higher costs for materials, tooling, and assembly, which may price microfiber mops out of reach for cost-sensitive consumers; and market pressure for low costs: manufacturers prioritize affordability, especially for household products, where consumers may prioritize price over advanced features.

Material and durability challenges: plastic limitations: most microfiber mop head assemblies use plastic due to its lightweight and low cost, but plastic components are inherently less durable than metal or other more robust materials, especially for products configured to secure different parts together; wear and tear on moving parts: more robust assemblies often involve more moving parts, which are prone to wear over time, especially under the repeated stress of wet/dry cycles; design complexity versus ease of use; user convenience: simpler assemblies (e.g., hook-and-loop and clips) are preferred for their ease of use, even if they sacrifice durability; more complex assemblies might be seen as cumbersome by consumers, reducing product appeal; assembly and maintenance: more robust assemblies may require precise alignment or more effort to attach and detach microfiber mops, which could deter users seeking simplicity.

Compatibility issues: standardization concerns: more advanced assemblies may not be universally compatible with existing mop handles or microfiber mops, limiting their adoption; manufacturers may hesitate to overhaul designs for fear of alienating existing customers.

Perceived trade-offs: "Good enough" design philosophy: many manufacturers operate under the assumption that existing solutions (e.g., hook-and-loop and clips) meet the needs of the majority of users; investing in innovation may not seem necessary when the current designs are widely accepted; targeted use: microfiber mops are often marketed for light-to-medium cleaning tasks; robust mop head assemblies are seen as more suitable for heavy-duty or industrial-grade mops.

Lack of consumer demand: limited feedback: most consumers are not vocal about the need for more robust alternatives unless they experience repeated failures; this lack of demand can discourage manufacturers from investing in better designs.

However, with advancements in materials (e.g., reinforced plastics and durable elastomers) and increasing consumer expectations, there is potential for more robust mob head assemblies for microfiber mops that balance durability with usability and cost, which is key to widespread adoption.

SUMMARY

The present invention provides a mop head assembly specifically designed for microfiber mops, offering a durable, secure, efficient and cost-effective cleaning solution. The assembly comprises a mop head receiver, a microfiber mop, and a mop head pressure insert, all working together to ensure a robust connection and enhanced cleaning performance.

The mop head receiver features an upper side with a mop handle removable receiver and a lower side that includes a circumferential wall, outward projections arranged in a circular pattern, and at least four pressure insert receiving apertures uniformly spaced around the perimeter of the circular pattern. This design ensures stable attachment and precise alignment of components.

The microfiber mop is positioned on the lower side of the mop head receiver and can include two sets of microfibers overlaid at ninety degrees for improved cleaning coverage and efficiency.

The mop head pressure insert is designed with either a quadrilateral frame with an interior cruciform structure or a plate structure, featuring outward projections and at least four pressure inserts that align with and secure into the at least four pressure insert receiving apertures in the mop head receiver. The pressure inserts can include one-way pressure tips to permanently secure the microfiber mop to the mop head receiver, ensuring a tight and reliable grip during use.

Additionally, the assembly is compatible with a removable mop handle, which attaches to the mop handle removable receiver for ease of use and replacement.

The object of the present invention is to provide a mop head assembly for microfiber mops that is robust, durable, and efficient in cleaning applications, while also facilitating secure assembly and maintenance of structural integrity over time.

BRIEF DESCRIPTION OF THE DRAWINGS

These and other features, aspects, and advantages of the present invention will become better understood with regards to the following description, appended claims, and drawings where:

DESCRIPTION

Figure 1:
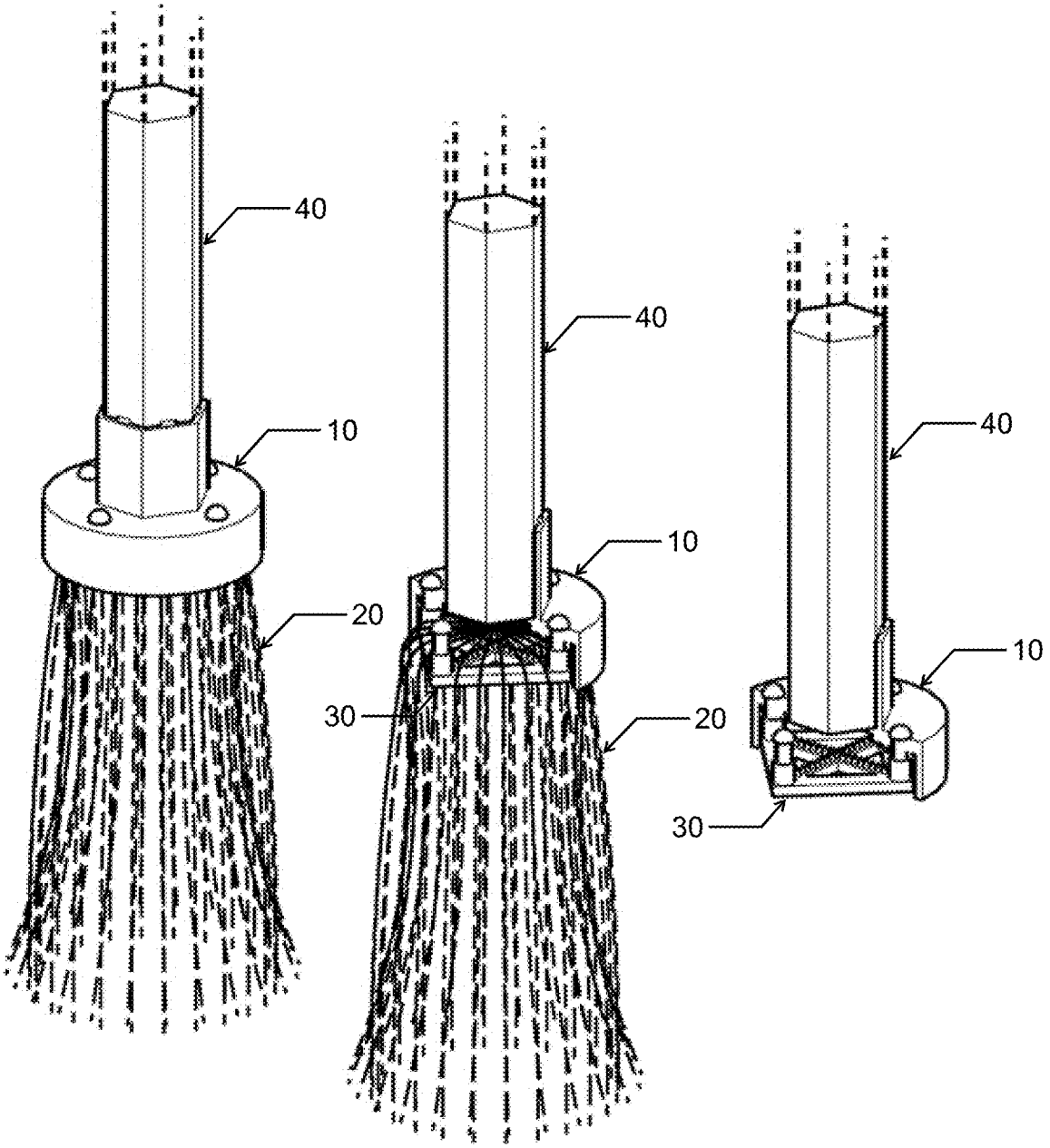
FIG. 1 is a perspective view of the present invention.
Figure 2:
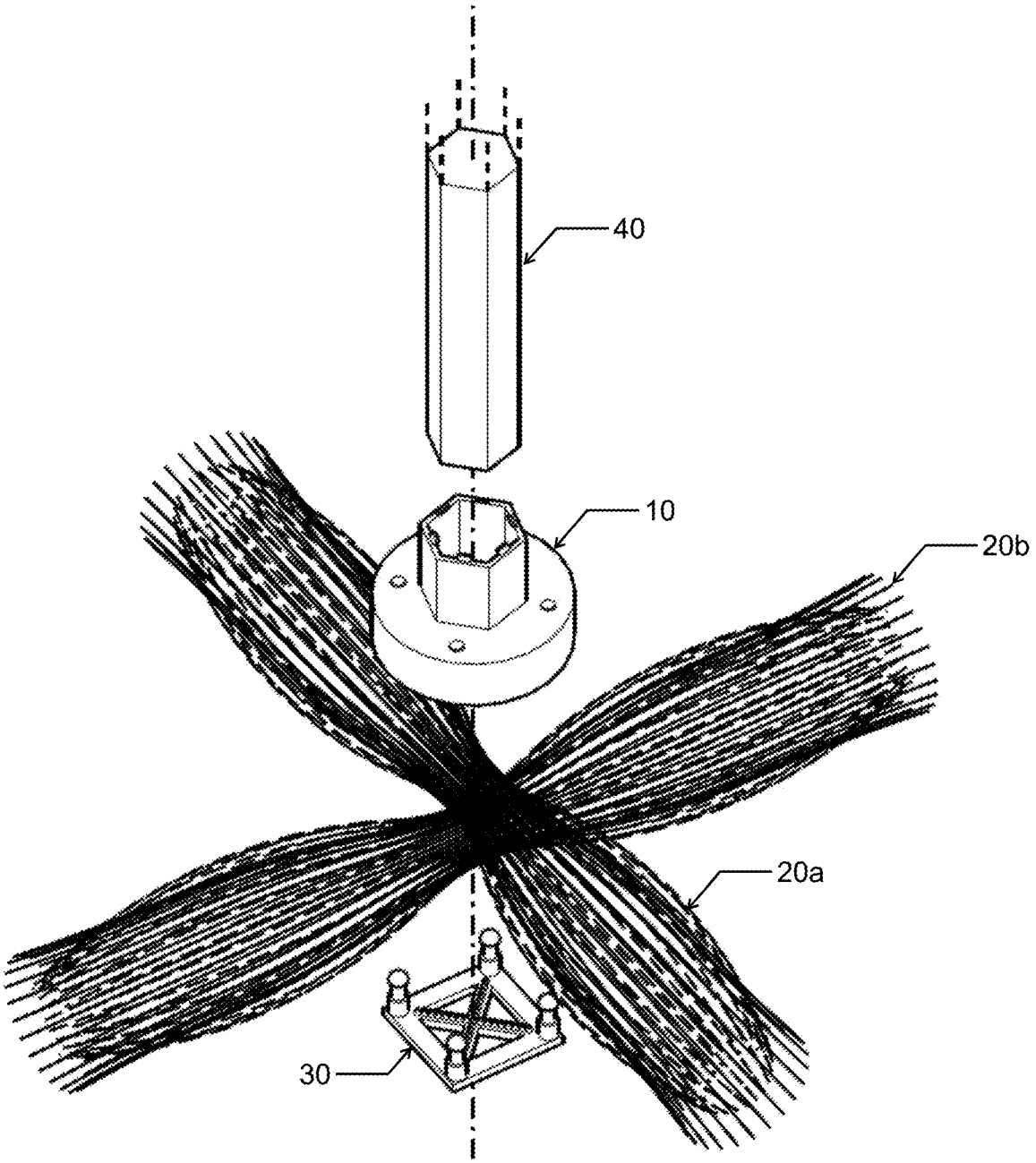
FIG. 2 is a perspective view of the present invention with two sets of microfibers overlaid at ninety degrees.
Figure 3:
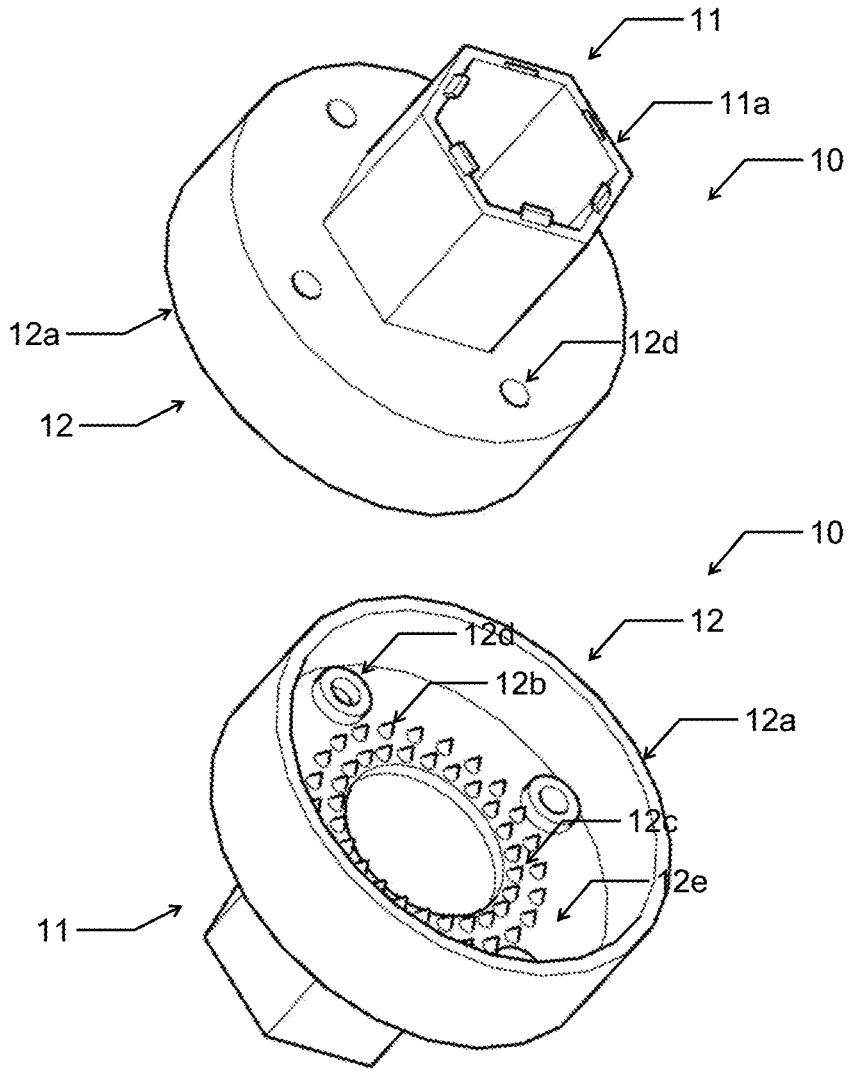
FIG. 3 is a perspective view of a mop head receiver.
Figure 4:
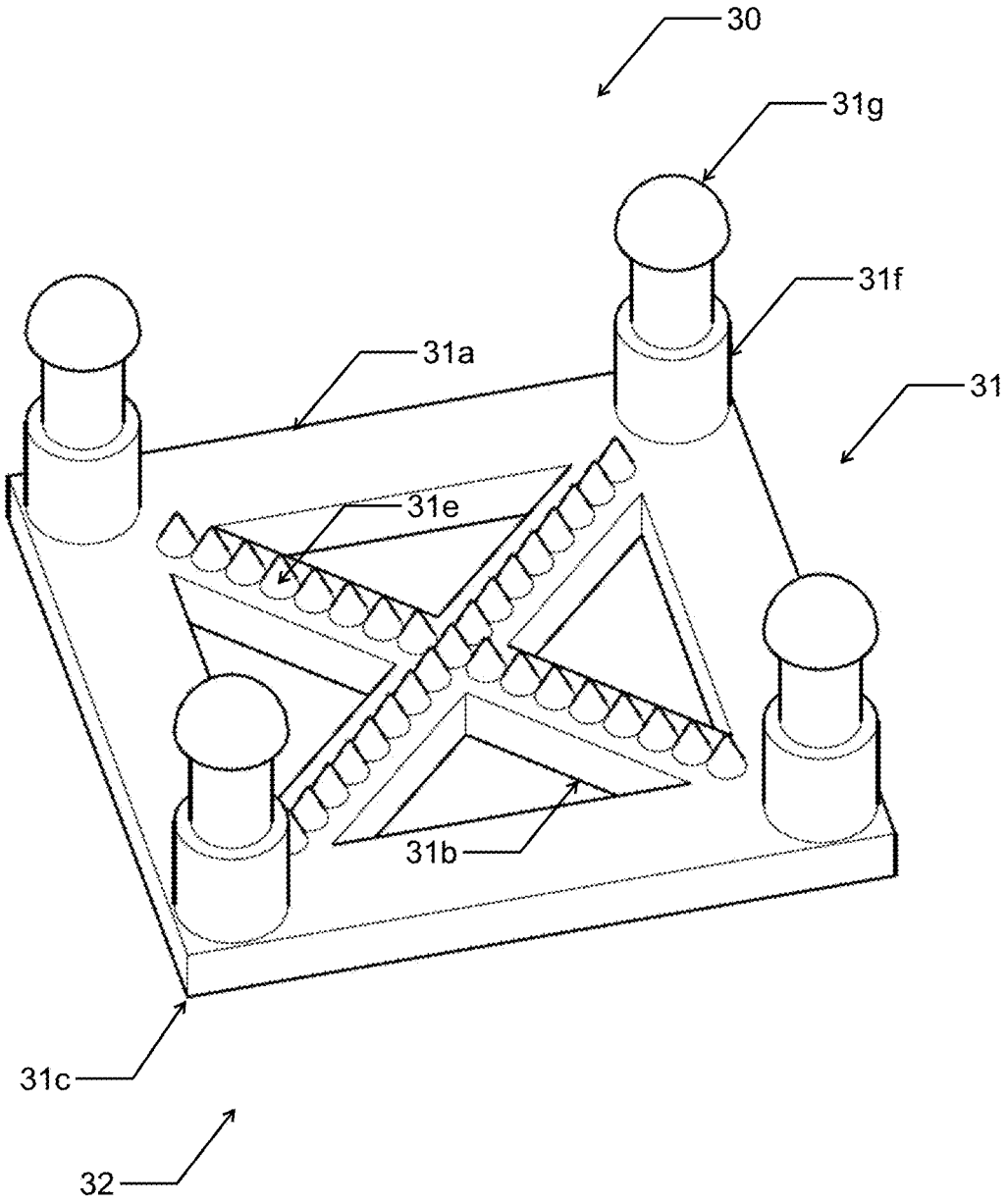
FIG. 4 is a perspective view of a mop head pressure insert with a frame and a cruciform structure.
Figure 5:
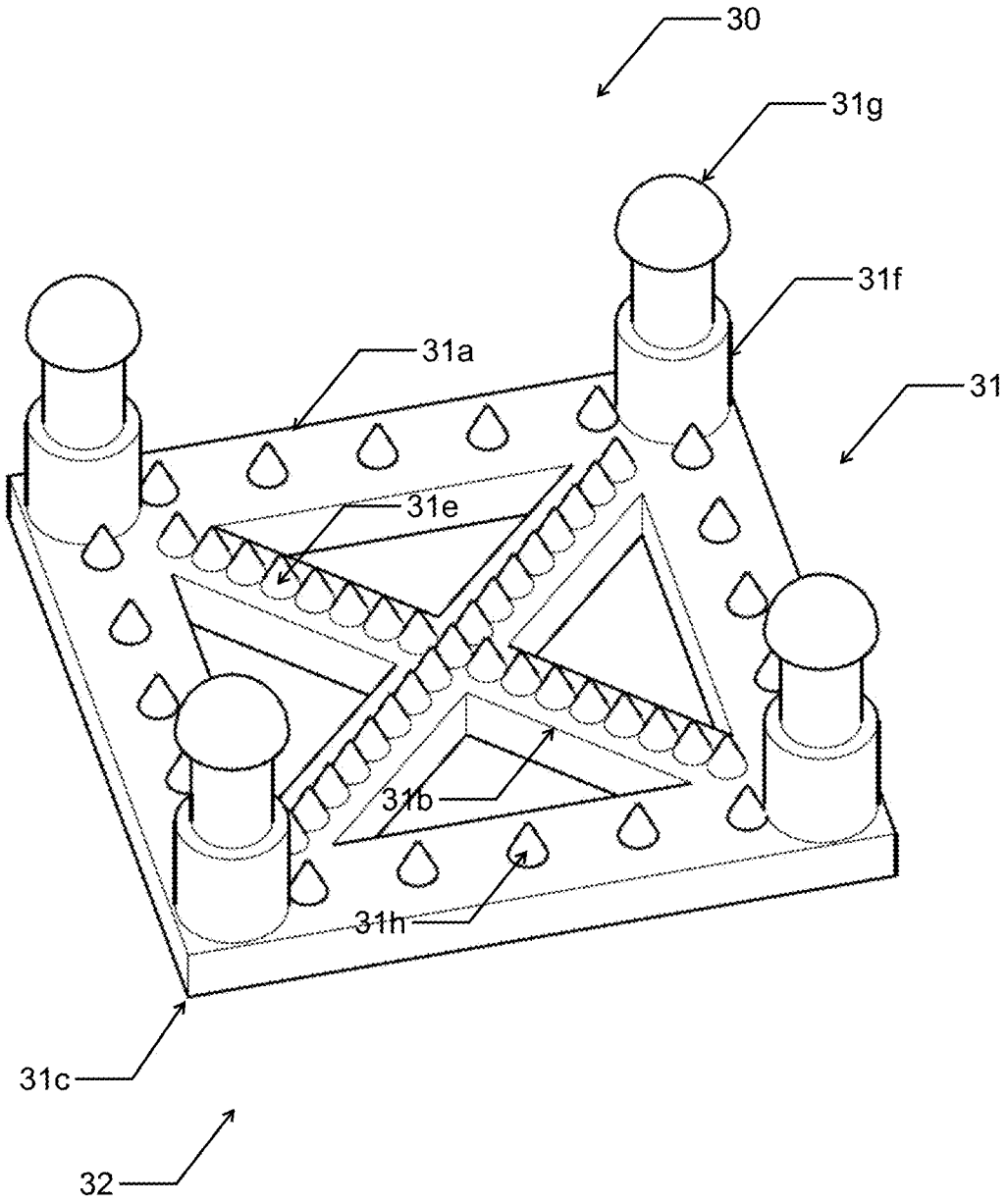
FIG. 5 is a perspective view of a mop head pressure insert with a frame and a cruciform structure, and projections on the frame.
Figure 6:
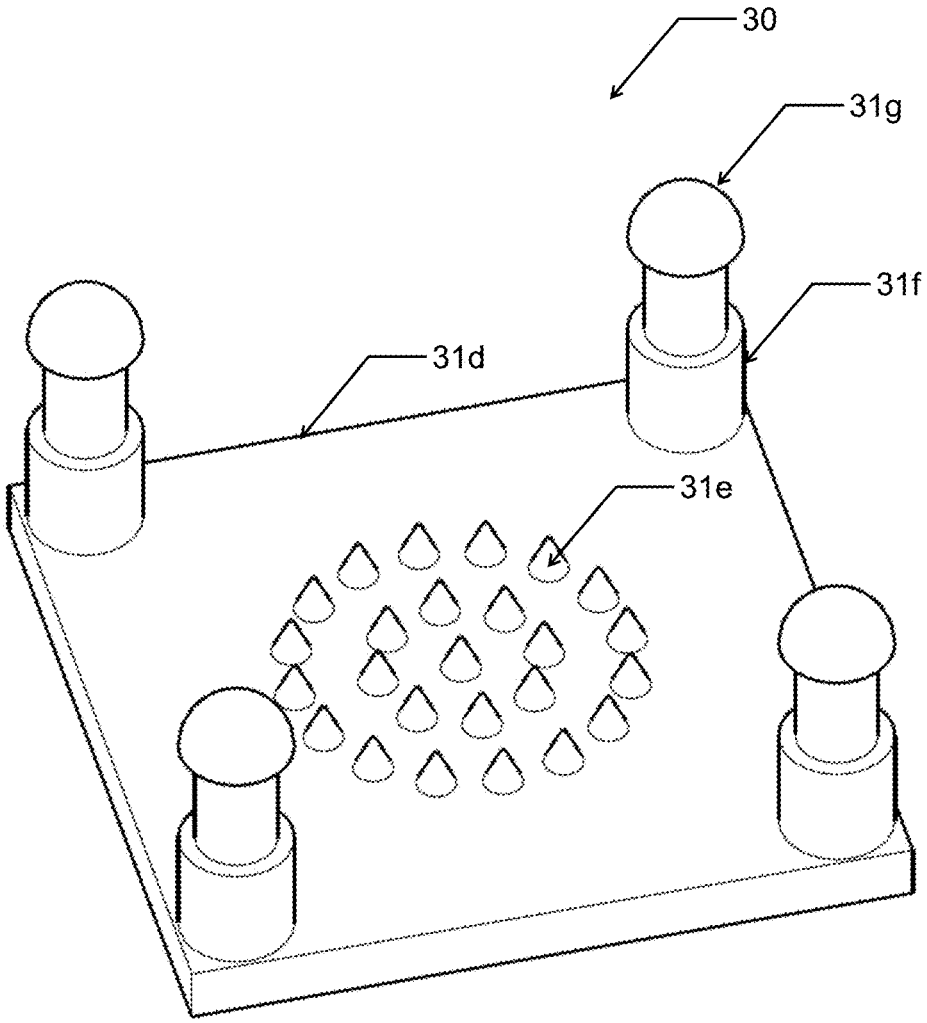
FIG. 6 is a perspective view of a mop head pressure insert with a plate structure.

As seen in FIGS. 1-6, the present invention is a mop head assembly for microfiber mops.

The mop head assembly for microfiber mops comprises a mop head receiver 10 that has an upper side 11 and a lower side 12. The upper side 11 has a mop handle removable receiver 11*a*, whereas the lower side 12 defines a circumferential wall 12*a* that extends from the lower side 12 at a perpendicular angle, a plurality of projections 12*b* that extend outward from the lower side 12 and are in a circular pattern 12*c*, and at least four pressure insert receiving apertures 12*d* that are uniformly spaced around an exterior perimeter 12*e* of the circular pattern 12*c*. A microfiber mop 20 that is placed on the lower side 12 of the mop head receiver 10. And, a mop head pressure insert 30 that has an upper side 31 and a lower side 32. The upper side 31 defines either a quadrilateral frame 31*a* with an interior cruciform structure 31*b* connected to its corners 31*c* or a plate structure 31*d* that has a plurality of projections 31*e* that extend outward from the upper side 31 of the mop head pressure insert 30, and at least four pressure inserts 31*f* that extend from the upper side 31 of the mop head pressure insert 30 at a perpendicular angle. The at least four pressure inserts 31*f* insert within the at least four pressure insert receiving apertures 12*d* of the mop head receiver 10.

In an embodiment of the present invention, the at least four pressure inserts 31*f* define a one-way pressure tip 31*g* configured to permanently secure the microfiber mop 20 to the mop head receiver 10.

In another embodiment of the present invention, the mop head assembly comprises a removable mop handle 40 that removably attaches to the mop handle removable receiver 11*a*.

In another embodiment of the present invention, the quadrilateral frame 31*a* has a plurality of projections 31*h* that extend outward from the upper side 31 of the mop head pressure insert 30.

In yet another embodiment of the present invention, the microfiber mop 20 defines a first set of microfibers 20*a* atop a second set of microfibers 20*b* at a relative angle of about ninety degrees.

An advantage of the present invention is that it provides enhanced structural integrity. The mop head pressure insert structure described adds rigidity and strength to the mop head pressure insert. This design ensures that the mop head can withstand repeated pressure and forces applied during use, such as scrubbing or vigorous mopping, without deforming or failing.

Another advantage of the present invention is that it provides uniform pressure distribution. The mop head pressure insert structure described helps to evenly distribute pressure across the entire mop head. This ensures that the microfiber mop attached to the lower side of the mop head receiver maintains consistent contact with the surface being cleaned, improving cleaning efficiency and preventing uneven wear.

Another advantage of the present invention is that it provides enhanced stability. The projections extending outward from the upper side of the mop head pressure insert add additional points of stabilization when assembled. These projections likely interface with corresponding structures in the mop head receiver, reducing wobbling or misalignment during use.

Another advantage of the present invention is that it provides a secure assembly. Increased points of interconnection are provided within the assembly described, which ensures that all components stay securely in place during use.

Another advantage of the present invention is that it provides increased durability against lateral and torsional forces. The mop head pressure insert structure described helps resist lateral (side-to-side) and torsional (twisting) forces applied to the mop head during cleaning. This improves the longevity of the mop head assembly, as these forces are common during use and can otherwise cause wear or failure.

Still another advantage of the present invention is that it provides improved force transfer. The assembly described enhances the transfer of force from the mop handle down to the microfiber mop. The design of the mop head pressure insert ensures that the applied force is not concentrated only at certain points but is instead distributed effectively across the mop head.

The embodiments of the mop head assembly herein are exemplary and numerous modifications, combinations, variations, and rearrangements can be readily envisioned to achieve an equivalent result, all of which are intended to be embraced within the scope of the appended claims. Further, nothing in the above-provided discussions of the mop head assembly should be construed as limiting the invention to an embodiment or a combination of embodiments. The scope of the invention is defined by the description, drawings, and claims.

What is claimed is:

1. A mop head assembly for microfiber mops, the mop head assembly comprises:

a mop head receiver that has an upper side and a lower side, the upper side has a mop handle removable receiver, the lower side defines a circumferential wall that extends from the lower side at a perpendicular angle, the lower side defines a plurality of projections that extend outward from the lower side and are in a circular pattern from a central axis point of the lower side, and at least four pressure insert receiving apertures that are uniformly spaced around an exterior perimeter of the circular pattern;

a microfiber mop that is placed on the lower side of the mop head receiver; and a mop head pressure insert that has an upper side and a lower side, the upper side defines a quadrilateral frame that has an interior cruciform structure that connects to the corners of the quadrilateral frame, the interior cruciform structure has a plurality of projections that extend outward from the upper side of the mop head pressure insert, and at least four pressure inserts that extend from the upper side of the mop head pressure insert at a perpendicular angle, the at least four pressure inserts insert within the at least four pressure insert receiving apertures of the mop head receiver.

2. The mop head assembly for microfiber mops of claim 1, wherein the at least four pressure inserts define a one-way pressure tip configured to permanently secure the microfiber mop to the mop head receiver.

3. The mop head assembly for microfiber mops of claim 2, wherein the mop head assembly comprises a removable mop handle that removably attaches to the mop handle removable receiver.

4. The mop head assembly for microfiber mops of claim 1, wherein the quadrilateral frame has a plurality of projections that extend outward from the upper side of the mop head pressure insert.

5. The mop head assembly for microfiber mops of claim 4, wherein the at least four pressure inserts define a one-way pressure tip configured to permanently secure the microfiber mop to the mop head receiver.

6. The mop head assembly for microfiber mops of claim 5, wherein the mop head assembly comprises a removable mop handle that removably attaches to the mop handle removable receiver.

7. The mop head assembly for microfiber mops of claim 1, wherein the microfiber mop defines a first set of microfibers atop a second set of microfibers at a relative angle of about ninety degrees.

8. The mop head assembly for microfiber mops of claim 7, wherein the at least four pressure inserts define a one-way pressure tip configured to permanently secure the microfiber mop to the mop head receiver.

9. The mop head assembly for microfiber mops of claim 8, wherein the mop head assembly comprises a removable mop handle that removably attaches to the mop handle removable receiver.

10. A mop head assembly for microfiber mops, the mop head assembly comprises:

a mop head receiver that has an upper side and a lower side, the upper side has a mop handle removable receiver, the lower side defines a circumferential wall that extends from the lower side at a perpendicular angle, the lower side defines a plurality of projections that extend outward from the lower side and are in a circular pattern from a central axis point of the lower side, and at least four pressure insert receiving apertures that are uniformly spaced around an exterior perimeter of the circular pattern;

a microfiber mop that is placed on the lower side of the mop head receiver; and a mop head pressure insert that has an upper side and a lower side, the upper side defines a plate structure that has a plurality of projections that extend outward from the upper side of the mop head pressure insert, and at least four pressure inserts that extend from the upper side of the mop head pressure insert at a perpendicular angle, the at least four pressure inserts insert within the at least four pressure insert receiving apertures of the mop head receiver.

11. The mop head assembly for microfiber mops of claim 10, wherein the at least four pressure inserts define a one-way pressure tip configured to permanently secure the microfiber mop to the mop head receiver.

12. The mop head assembly for microfiber mops of claim 11, wherein the mop head assembly comprises a removable mop handle that removably attaches to the mop handle removable receiver.

13. The mop head assembly for microfiber mops of claim 10, wherein the microfiber mop defines a first set of microfibers atop a second set of microfibers at a relative angle of about ninety degrees.

14. The mop head assembly for microfiber mops of claim 13, wherein the at least four pressure inserts define a one-way pressure tip configured to permanently secure the microfiber mop to the mop head receiver.

15. The mop head assembly for microfiber mops of claim 14, wherein the mop head assembly comprises a removable mop handle that removably attaches to the mop handle removable receiver.

* * * * *